US005676630A

United States Patent [19]

Mayr

[11] Patent Number: 5,676,630

[45] Date of Patent: Oct. 14, 1997

[54] FOLDER DEVICE WITH FORMAT CONVERSION

[75] Inventor: Robert Mayr, Neusäss, Germany

[73] Assignee: MAN Roland Druckmaschinen AG, Offenbach am Main, Germany

[21] Appl. No.: 509,128

[22] Filed: Jul. 31, 1995

[30] Foreign Application Priority Data

Jul. 29, 1994 [DE] Germany ..... 44 26 987.0

[51] Int. Cl.[6] ..... B31F 1/10

[52] U.S. Cl. ..... 493/424; 493/429; 493/476

[58] Field of Search ..... 493/424–433, 493/476; 270/37, 38, 42, 45, 47, 49, 50; 226/111; 242/535, 535.5, 564.3, 564.4; 83/287, 288, 311, 312

[56] References Cited

U.S. PATENT DOCUMENTS

| | | | |
|---|---|---|---|
| 2,082,262 | 6/1937 | Sather | 493/431 |
| 2,981,540 | 4/1961 | Harless | 493/431 |
| 3,144,249 | 8/1964 | Bryer | 493/431 |
| 3,348,837 | 10/1967 | Bolza-Schunemann | 493/431 |
| 3,540,723 | 11/1970 | Bolza-Schunemann et al. | 493/431 |
| 4,218,053 | 8/1980 | Heimlicher | 493/429 |
| 4,279,410 | 7/1981 | Bolza-Schünemann | 270/50 |
| 4,352,671 | 10/1982 | Petersen | 493/424 |
| 4,895,356 | 1/1990 | Rudolf | 270/49 |
| 5,072,919 | 12/1991 | Schneider et al. | 270/50 |
| 5,096,175 | 3/1992 | Lange et al. | 493/425 |
| 5,201,701 | 4/1993 | Roetiger et al. | 493/425 |
| 5,242,367 | 9/1993 | Marmin | 493/424 |
| 5,284,466 | 2/1994 | Magnusson et al. | 493/432 |
| 5,443,437 | 8/1995 | Mack | 493/429 |
| 5,507,714 | 4/1996 | Furuta et al. | 493/424 |
| 5,520,378 | 5/1996 | Kepert et al. | 493/432 |

FOREIGN PATENT DOCUMENTS

| | | |
|---|---|---|
| 0531648 | 3/1993 | European Pat. Off. . |
| 739360 | 9/1943 | Germany . |
| 1126412 | 3/1962 | Germany . |
| 1894733 | 6/1964 | Germany . |
| 1246767 | 8/1967 | Germany . |

*Primary Examiner*—Joseph J. Hail, III
*Assistant Examiner*—Darren Ark
*Attorney, Agent, or Firm*—Cohen, Pontani, Lieberman, Pavane

[57] ABSTRACT

A folder device that can be converted from parallel fold to delta fold, and the pre-fold of which is also convertible. The device includes cylindrical segments respectively, that are turned relative to one another by two planetary gear trains, which are adjustable relative to one another, so that the respective transmissions of the planetary gear trains balance one another. The adjustment of the cylindrical segments is carried out in dependence on the adjustment of the planetary gear trains.

9 Claims, 6 Drawing Sheets

FOLDER DEVICE WITH FORMAT CONVERSION

BACKGROUND OF THE INVENTION

1. Field of the Invention

The invention relates to a folder device having at least two folding cylinders arranged after a cutting cylinder, at least one of which has two nested adjustable cylindrical bodies. The first of the cylindrical bodies works together with the cutting cylinder, while the other cylindrical body works together with the at least one cylindrical body of the second folding cylinder. The second cylindrical body can be jointly adjusted together with the at least one cylindrical body of the second folding cylinder.

2. Description of the Prior Art

A folder device of this type is already known from EP 0 531 648 A1. This folder device also has a third folding cylinder which permits the device to produce both a first fold and a second fold, the latter may be a double parallel fold or a delta fold. The aforementioned folds are generally carried out on printing stock webs, which have already been given a longitudinal fold in the longitudinal direction by a former. Along with the option of choosing between a double parallel fold and a delta fold and the option of simply making a first fold, it is often necessary to provide a pre-fold. In this case, the first folding cylinder, too, must consist of two nested independent cylindrical segments that can be moved relative to one another and each have driving gearwheels. These two cylindrical segments are used only to permit the pre-fold to be set by moving the respective driving gearwheels by an angle of just a few degrees. The driving gearwheels are always coupled to one another in pairs, in order to synchronize the elements that must work together as the sheets run between the two adjacent cylinders. To set the pre-fold, a single combing roller is used, for example, which during normal operation of the folder device is driven by one gearwheel pair of the cylinder in question. One section of this combing roller engages into one of the gearwheels, while the other section engages into the other gearwheel. By means of a slight axial movement of the helically-toothed combing roller, the axis of which remains parallel to the axis of the cylinder in question, which results in a slight angular movement in the desired direction between the associated gearwheel pair, it is possible to achieve a slight angular movement ,of a few degrees, sufficient for adjusting the pre-fold. It is evident, however, that in the case of an angular movement of 15°, for example, which is necessary to change from a parallel fold to a delta fold, other means must be used. According to EP 0 531 648 A1, the driving gearwheels of the two cylindrical segments of the transport cylinder, on the one hand, and the driving gearwheels of the cylindrical segments of the second folding cylinder, on the other, are respectively coupled to one another via a coaxial gearwheel pair interconnected via a separable coupling. Separating the coupling between the gearwheels of each gearwheel pair makes it possible to change the angular distance between the cylindrical segments of the particular cylinder in question, in order to switch the folder device from the production of a double parallel fold to the production of a delta fold or vice versa.

SUMMARY OF THE INVENTION

Accordingly, it is an object of the present invention to create, in a folder device of the type mentioned above, an even simpler way to adjust the pre-fold or to change between parallel folding and delta folding.

Pursuant to this object, and others which will become apparent hereafter, one aspect of the present invention resides in a folder device having at least two folding cylinders arranged after a cutting cylinder. At least one of the folding cylinders has at least two nested and adjustable cylinder body segments. A first of the cylinder body segments is arranged to work together with the cutting cylinder while a second of the cylindrical segments works together with at least one cylindrical segment of the second folding cylinder. The second cylindrical segment of the first folding cylinder is jointly adjustable together with the at least one cylindrical body of the second folding cylinder. The first and the second cylindrical segments of the first folding cylinder are connected together via two planetary gear trains so as to be adjustable relative to one another, which gear trains have transmissions that balance one another.

According to the invention, two equiaxial planetary gears are used, which transfer power from the first driving gear of the first cylindrical segment to the second driving gear of the second cylindrical segment, which is adjustable relative to the first segment, whereby the transmissions of the planetary gears balance one another.

Pursuant to another embodiment of the invention the second folding cylinder also has two cylindrical segments. Furthermore, a third folding cylinder having two cylindrical segments is arranged after the second folding cylinder. The second cylindrical segment of the second folding cylinder works together with the first cylindrical segment of the third folding cylinder. The second cylindrical segment of the second folding cylinder and the first cylindrical segment of the third folding cylinder being connected together so as to be adjustable relative to the two other cylindrical segments of these folding cylinders via planetary gear trains which are adjustable relative to one another and have transmissions that balance one another.

In still another embodiment of the invention the planetary gear trains are concentrically mounted around a shaft of the cylindrical segments of the first folding cylinder and/or the second folding cylinder. In another embodiment each of the planetary gear trains includes fixed internally-toothed rings, an internal gearwheel, and planetary gearwheels arranged to rotate in the internally-toothed rings around the internal gearwheel as a shared sun gear.

Yet another embodiment of the invention provides that at least one of the planetary gear trains is adjustable via an adjustment drive relative to the remaining planetary gear trains.

The folding cylinders can be any one of point-and-folding-knife cylinders, folding blade cylinders, gripper-and-folding-knife cylinders, gripper-and-folding-blade cylinders or grip or cylinders.

In yet another embodiment of the invention the sheared sun wheel of the respective planetary gear trains which are connected via the sun gear, has no fixed connection to one of the associated cylindrical segments and is freely turnable.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
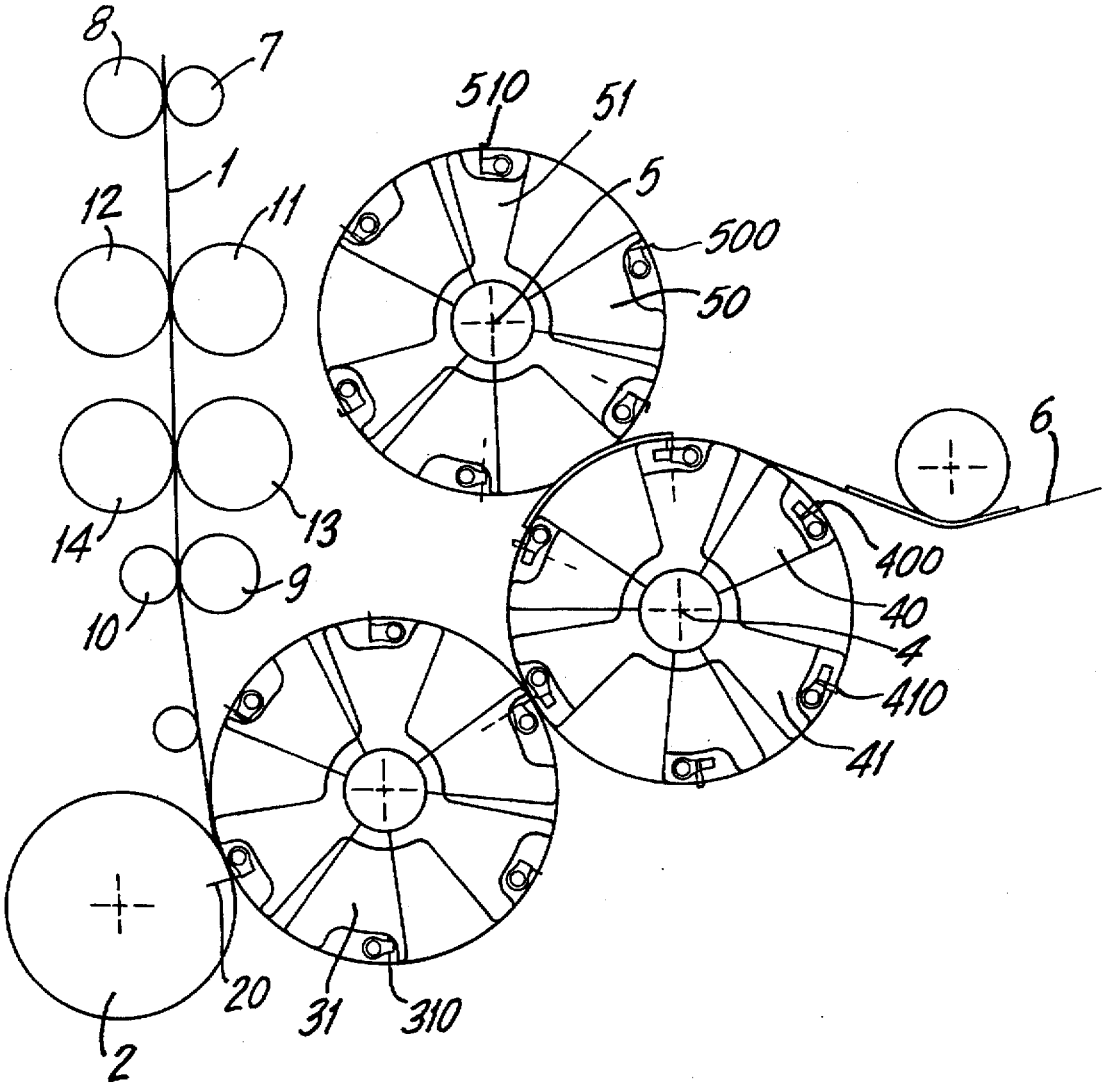
FIG. 1 is an end view of a folder device pursuant to the present invention with a cutting cylinder, a point-and-folding-knife cylinder, a folding blade cylinder as well as a gripper-and-folding-knife cylinder in the format setting for producing a single cross fold.

FIG. 1 illustrates a folder device for cutting a paper web 1 crosswise. The folder device has a cutting cylinder 2, which works together with the first folding cylinder which is a point-and-folding-knife cylinder 3. Another folding cylinder, the folding blade cylinder 4, is arranged after the point-and-folding-knife cylinder 3. The point-and-folding-knife cylinder 3 works together with the folding blade cylinder 4 to fold the sheets cut by the cutting cylinder 2 crosswise one time, i.e., to produce a normal fold. When the paper sheets are to be folded a second time, another folding cylinder, the gripper-and-folding-knife cylinder 5, works together with the folding blade cylinder 4. The folded copies are subsequently transported further via a belt line 6. Before the paper web 1 is cut by the common action of the cutting cylinder 2 and the point-and-folding-knife cylinder 3, the web is run between feed rollers 7 to 10 and perforating rollers 11 to 14.

The point-and-folding-knife cylinder 3, the folding blade cylinder 4 and the gripper-and-folding-knife cylinder 5 consist, respectively, of two cylindrical segments 30, 31; 40, 41; and 50, 51 rotatable relative to one another. The cylindrical segment 30 is equipped with three rows of point needles 300, which work together with the cutting knives 20 of the cutting cylinder 2. To change the position of the fold in respect to the point needles 300, the cylindrical segment 31 having folding knives 310 and the cylindrical segment 41 of the folding blade cylinder 4 must be simultaneously moved by the same angle, so that the folding knives 310 can introduce the folding products into the folding blades 410 of the cylindrical segment 41.

Similarly, when the folder device also offers the option of a second fold, as is the case in this example, the grippers 510 of the cylindrical segment 51 must also be moved; so as to be able to pick up the products already folded one time by the folding blades 410 of the folding blade cylinder 4.

In order to fold the products a second time, the folding knives 500, which are arranged on the cylindrical segment 50, work together with folding blades 400 arranged on the cylindrical segment 40 of the folding blade cylinder 4, and are adjustable together with them.

Figure 2:
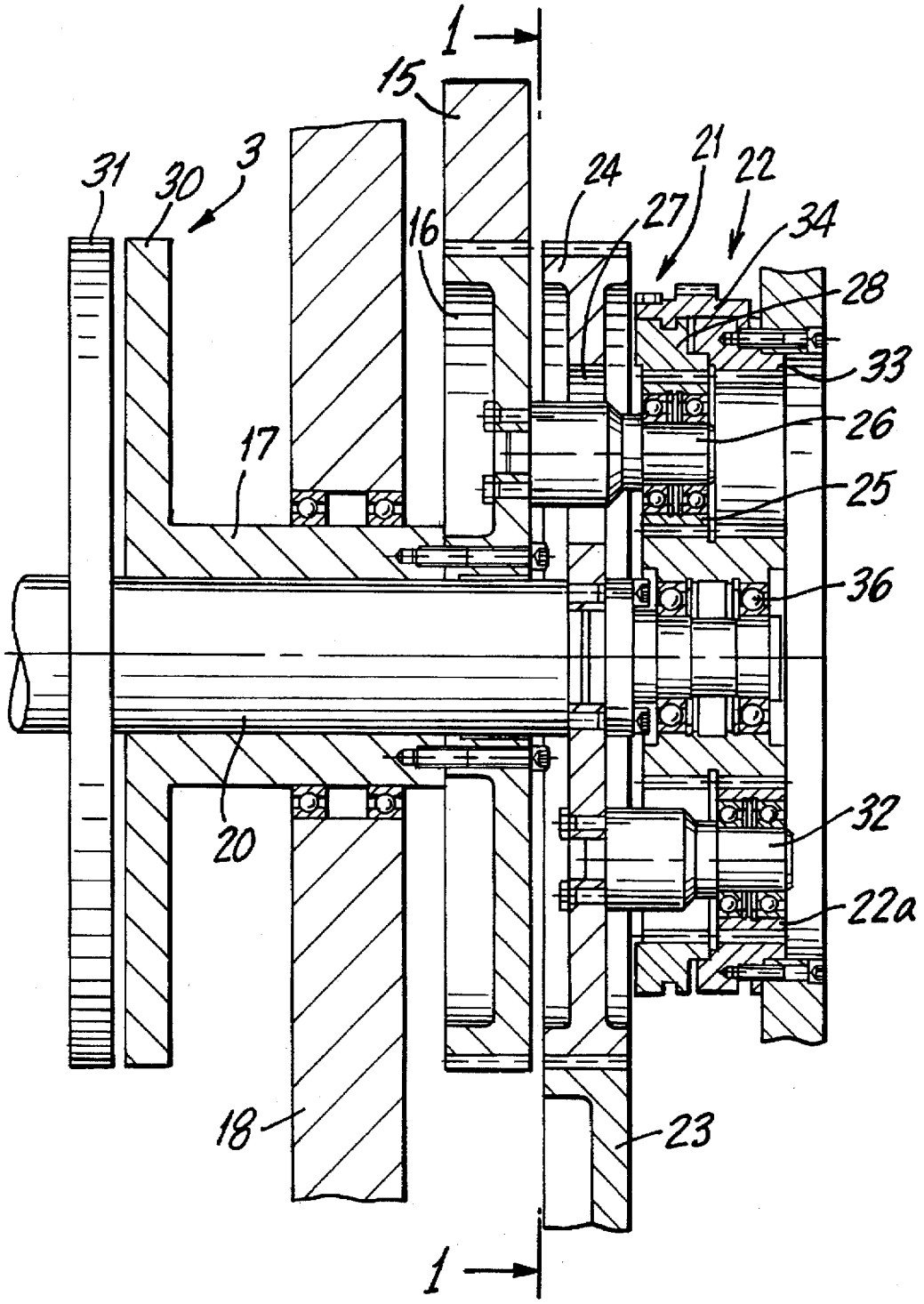
FIG. 2 is a cross-section through the point-and-folding-knife cylinder in FIG. 1 along Line I—I.
Figure 5:
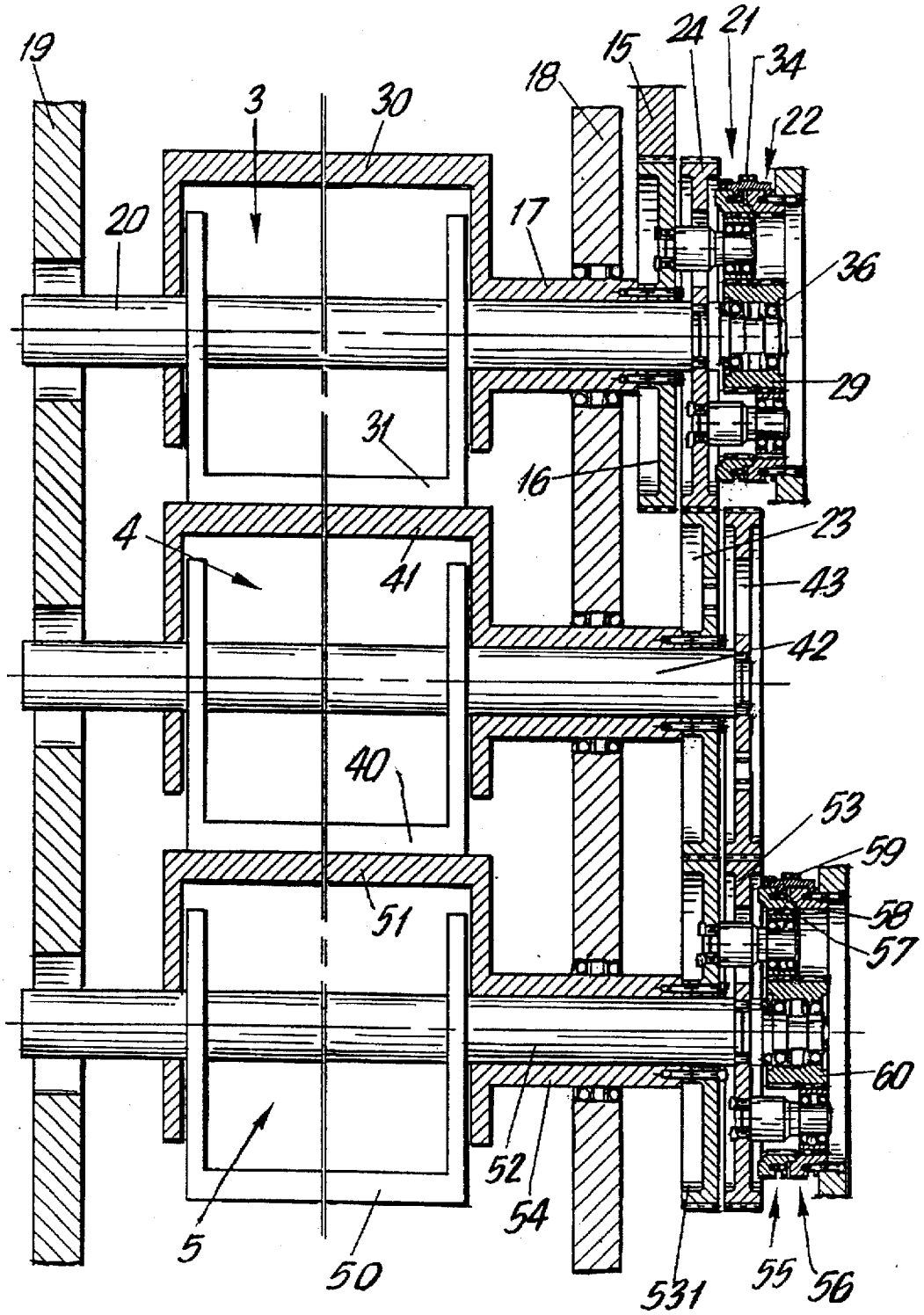
FIG. 5 is a cross-section of the point-and-folding-knife cylinder, the folding blade cylinder and the gripper-and-folding-knife cylinder as well as the drive.

The cylindrical segment 30 of the point-and-folding-knife cylinder 3, as shown in FIG. 2, is driven via a gearwheel 15 connected to the cutting cylinder 2 and a driving gearwheel 16 via a hollow shaft 17. The shaft 17 is rotatably mounted in side walls 18 and 19, as seen in FIG. 5. The hollow shaft 17 surrounds a shaft 20 located in its interior, which turns the cylindrical segment 31. The shafts 17 and 20, and thus the cylindrical segments 30 and 31, are coupled to one another via two planetary gear trains 21, 22. The planetary gear trains 21, 22 create the drive connection between the driving gearwheel 16 and a follower gearwheel 23, which is driven by the driving gearwheel 16 via a second-driving gearwheel 24.

A planetary gear 25 of the planetary gear train 21 is connected to the driving gearwheel 16 via a bolt 26. The bolt 26 extends through an opening 27 in the second drive gearwheel 24. The planetary wheel 25 drives an internal gearwheel 29, the sun gear, via a stationary internally-toothed ring 28. The internal gearwheel 29 is mounted via a bearing 36 in a fashion permitting rotation around the shaft 20. the internal gearwheel 29 has no fixed connection to the cylindrical segments 30, 31 and can turn freely.

The internal gearwheel 29 in turn drives another planetary gear 31, via an internally-toothed ring 33. The planetary gear 31 belongs to the planetary gear train 22. A planetary gear 31 in turn drives the second-driving gearwheel 24 via a bolt 32. The bolts 26 and 32 are rotatably mounted in the planetary gears 25 and 31, respectively, via ball bearings, for example, so that the planetary gears 25 and 31 can rotate around their own axes. The rotational movement of the planetary gears 25, 31 around the central axis formed by the middle of the shafts 17, 20 is transmitted by the bolts 26, 32 from the driving gearwheel 16 to the second driving gearwheel 24.

To change the angular position between the cylindrical segments 30 and 31, at least one of the two internally-toothed rings 28, 33 must be turned relative to the other ring 33, 28. For this purpose, a known drive not described in greater detail is used, which meshes with a toothed rim 34 attached to the ring 28. This adjustment may be carried out by an electric motor, a hydraulic or pneumatic cylinder, or even manually.

Figure 3:
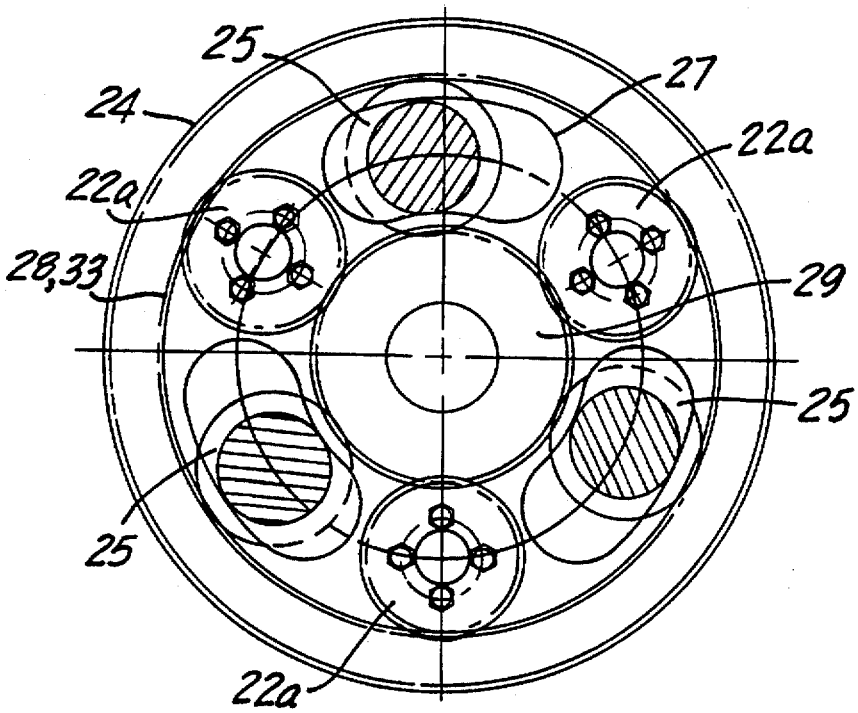
FIG. 3 is a top view of the planetary gears for driving the cylindrical segments of the point-and-folding-knife cylinder or of the gripper-and-folding-knife cylinder.

As shown in FIG. 3, preferably, three planetary gears 25, 31 which mesh with the internal gearwheel 29, are arranged in each of the internally-toothed rings 28, 33. Compared to having only a single planetary gear 25, 31 in each case, the arrangement of two or more planetary gears results in a more even transmission of power and avoids states of unbalance. The openings 27 to the second driving gearwheel 24 are oval in shape and are large enough to permit a turn of 30°, for example, between the rings 28 and 33, which is necessary during conversion from the first cross fold to the first delta fold and vice versa, which is produced between the point-and-folding-knife cylinder 3 and the folding blade cylinder 4.

Figure 4:
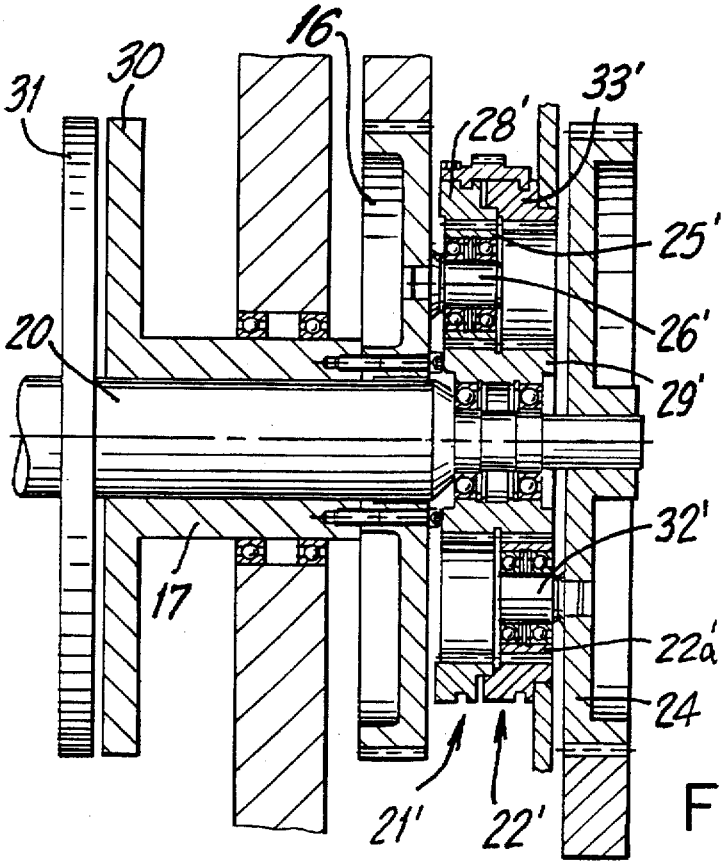
FIG. 4 is a schematic depiction of the drive of the cylindrical segments of the point-and-folding-knife cylinder, with the planetary gears arranged between the driving gearwheels.

When it is necessary to set even larger turns between the rings 28 and 33, the planetary gear trains (as shown in FIG. 4 in reference to the planetary gear trains 21' and 22') may also be arranged between the driving gearwheel 16 and the second driving gearwheel 24. In this case, no openings 27 for the bolt 26 are necessary in the second driving gearwheel 24. The bolts 26', 32' connect the planetary gears 25', 31' to the driving gearwheel 16 and the second driving gearwheel 24. In this example, any desired turn may be carried out between the internally-toothed rings 28', 33'. The transmission ratio i=1 between the planetary gear trains 21, 22 as well as 21', 22' is achieved through the same ratio of the tooth numbers between the internally-toothed rings 28, 28' and 33, 33' in each of the planetary gear trains 21, 21', 22, 22', to the internal gearwheels 29, 29', the sun gears. Instead of the planetary gear trains 21, 22, 21', 22' described here, any other desired planetary gears may be used, for example, gears having externally-toothed rings, provided that their respective transmissions balance.

The cylindrical segment 41 of the folding blade cylinder 4 is driven via the follower gearwheel 23 (FIG. 5). Thanks to the connection established (via the follower gearwheel 23) to the second-driving gearwheel 24 and thus to the cylindrical segment 31 carrying the folding knives 310, the folding knives 310 always work together with the folding blades 410 in an angle-true fashion. To ensure that the folding blades 410 of the cylindrical segment 41 also mesh with the grippers 510 of the cylindrical segment 51 on the gripper-and-folding-knife cylinder 5 in an equally angle-true fashion, gearwheels 43, 53 arranged on the shafts 42, 52 belonging to the cylindrical segments 41, 51 are engaged with one another in a corresponding manner. Additionally, the gearwheels 23, 531, of the hollow shafts of the cylindrical segments 41, 51, engage. However, to ensure that the folding knives 500 on the cylindrical segment 50, which produce the second fold, i.e., the double parallel fold or the second delta fold, can be adjusted relative to the grippers 510, so as to change the position of the fold, planetary gear trains 55 and 56 with a shared sun wheel 60 are arranged on the shaft 52 and the hollow shaft 54 surrounding it, in the same manner as with the shafts 17 and 20. At least one of the internally-toothed rings 57, 58 belonging to the planetary gear trains 55, 56 is in turn connected via an external tooth rim 59 to a drive (not shown here), in order to adjust the planetary gear trains 55, 56 relative to one another.

Figure 6:
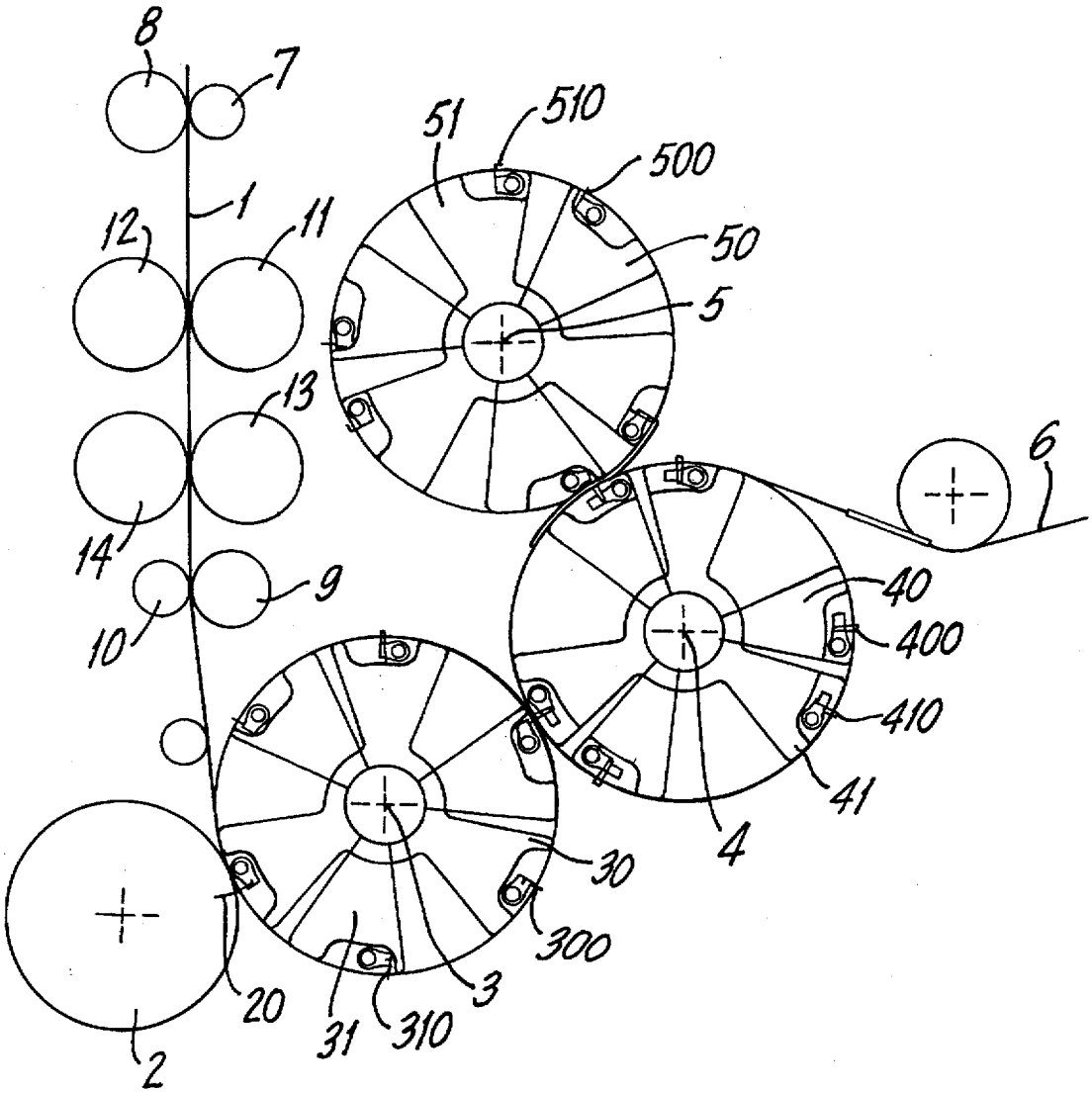
FIG. 6 is a view similar to FIG. 1 of the folder device in the format setting for a double parallel fold.

Thus, in order to fold the copies, which were folded crosswise one time in FIG. 1, a second time, the distance between the folding blades 400 and 410 of the folding blade cylinder 4 must be reduced in an equally angle-true fashion as the distance between the grippers 510 and the folding knives 500 of the gripper-and-folding-knife cylinder 5, so that the grippers 510 are able to work together with the folding blades 410, i.e., are able to grasp the folded copies from the folding blade cylinder 4, allowing the copies to subsequently be folded by the folding knives 500 and the folding blades 400. This is done by reducing the angle between the folding blades 400 and 410 from 65° (FIG. 1) to 30° (FIG. 6), so that the folding blades 400 and the folding knives 500, respectively, are positioned below the folded copies on the circumferential surface of the folding blade cylinder 4. Only in this way can the grippers 510 of the gripper-and-folding-knife cylinder 5 take along the folded copies and, when turned farther by means of the folding knives 500, give the copies back to the folding blade cylinder 4, in that the folding knives 500 insert the folded sheets into the folding blades 410. The folding blade cylinder 4 passes along the once-folded products from the folding blades 410 or the twice-folded products from the folding blades 400 to the belt line 6.

Figure 7:
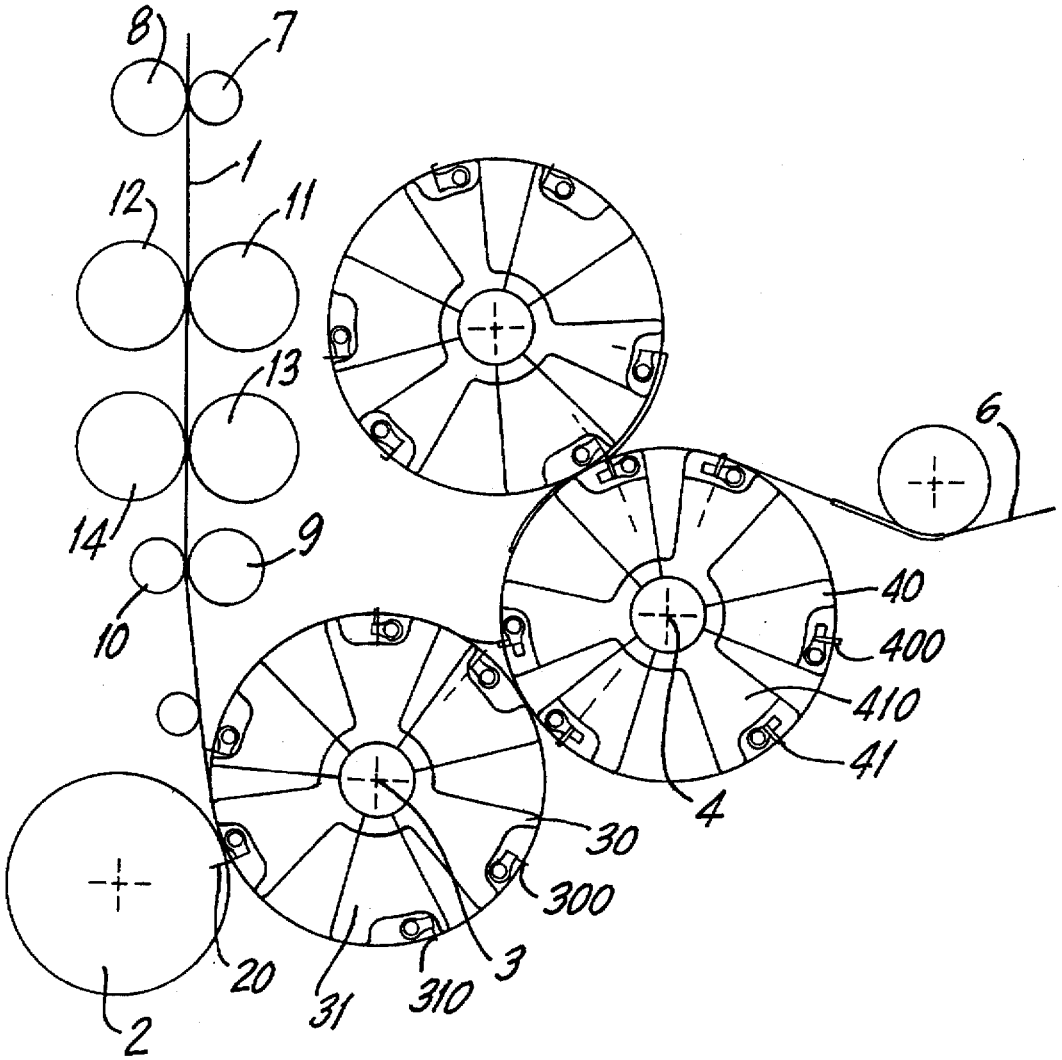
FIG. 7 shows the folder device as in FIG. 1 in the format setting for a delta fold.

In order to produce delta folds (FIG. 7), the planetary gear trains 21 and 22 as well as the planetary gear trains 55 and 56, respectively, must be adjusted relative to one another by means of the drives assigned to them via the tooth rims 34 and 59 (FIGS. 2 and 5). For this purpose, for example, the folding knives 310 are turned by 35° in a clockwise direction to the point needles 300 (first cross fold) and, in addition, the grippers 510 are set at a distance of 30° to the folding knives 500 (second cross fold). The cylindrical segments 40, 41 of the folding blade cylinder 4 are adjusted in an angle-true manner upon adjustment of the planetary gear trains 21, 22, 55, 56.

The use of the interacting planetary gear trains 21, 22 and 55, 56 is not limited to the folder device depicted here, but rather is equally usable in folder devices which work without point needles and in which gripper-and-folding-knife cylinders work together with gripper-and-folding-blade cylinders and in which, for example, a changeover between book and newspaper production is necessary, i.e., between producing a second cross fold and simply passing along products during newspaper production. Generally, the arrangements according to the invention of planetary gear trains may be used when rotating bodies consist of at least two segments that are to be adjusted relative to one another.

The invention provides a folder device that can be converted from producing only a single cross fold to producing a double parallel fold or delta fold, whereby the pre-fold is also convertible. The cylindrical segments 30, 31, 50, 51, respectively, are turned relative to one another by means of the two planetary gear trains 21, 22, 55, 56, which can be adjusted relative to one another, whereby the transmissions of the planetary gear trains 21, 22 and 55, 56 balance one another, in each case. The adjustment of the cylindrical segments 40, 41 is carried out in dependence on the adjustment of the planetary gear trains 21, 22 and 55, 56.

The invention is not limited by the embodiments described above which are presented as examples only but can be modified in various ways within the scope of protection defined by the appended patent claims.

I claim:

1. A folder device, comprising:

a cutting cylinder; a first shaft; at least a first folding cylinder and a second folding cylinder after the curing cylinder, the second folding cylinder having at least one cylindrical body segment, the first folding cylinder having at least two nested and adjustable cylindrical body segments mounted on the first shaft, a first of the cylindrical body segments of the first folding cylinder being arranged to work together with the cutting cylinder, and a second of the cylindrical body segments of the first folding cylinder being arranged to work together with the at least one cylindrical body segment of the second folding cylinder so that the second cylindrical body segment is jointly adjustable with the at least one cylindrical body segment of the second folding cylinder; a first driving gear wheel operatively provided to drive the first cylindrical body segment; and, two planetary gear trains having transmissions and being arranged concentrically on the first shaft to respectively connect together the first and second cylindrical body segments of the first folding cylinder, the planetary gear trains being adjustable relative to one another and the transmissions thereof being configured to balance one another so that the planetary gear trains together have a 1:1 gear ratio, a first of the planetary gear trains including planetary gear wheels turnably arranged on the first driving gear wheel, both the planetary gear trains including a shared sun gear arranged to be driven by the gear wheels so as to drive the second cylindrical body segment via gear wheels of a second of the planetary gear trains, wherein each of the planetary gear trains includes fixed internally-toothed rings, the planetary gear wheels being arranged to rotate in the fixed internally-toothed rings around the shared sun gear so as to effect relative adjustability between the planetary gear trains.

2. A folder device as defined in claim 1, wherein the second folding cylinder has two cylindrical body segments, and further comprising a third folding cylinder having first and second cylindrical body segments, the third folding cylinder being arranged after the second folding cylinder, a second cylindrical body segment of the second folding cylinder being in operative association with the first cylindrical body segment of the third folding cylinder, and still further comprising additional planetary gear trains operatively arranged to connect the second cylindrical body segment of the second folding cylinder and the first cylindrical body of the third folding cylinder so as to be adjustable relative to the first cylindrical body of the second folding cylinder and the second cylindrical body segment of the third folding cylinder, the planetary gear trains being adjustable relative to one another and having transmissions that are configured to balance one another.

3. A folder device as defined in claim 2, and further comprising a second shaft on which the cylindrical body segments of the third folding cylinder are mounted, the two planetary gear trains are concentrically mounted around the first shaft and the additional planetary gear trains are concentrically mounted around the second shaft.

4. A folder device as defined in claim 3, wherein each of the planetary gear trains includes fixed internally-toothed rings, the planetary gear wheels being arranged to rotate in the internally-toothed rings around the shared sun gear.

5. A folder device as defined in claim 1, and further comprising a second driving gear wheel in operative connection with a cylindrical body segment of the second folding cylinder, the planetary gear wheels of the second planetary gear train being connected to the second driving gear wheel so as to be in operative connection with the cylindrical segment of the second folding cylinder.

6. A folding device as defined in claim 3, and further comprising adjustment drive means for adjusting at least one of the planetary gear trains relative to the remaining planetary gear train.

7. A folder device as defined in claim 1, wherein the folding cylinders are any one of point-and-folding-knife cylinders, folding blade cylinders, gripper-and-knife cylinders, gripper-and-folding-blade cylinders and gripper cylinders.

8. A folder device as defined in claim 1, wherein the internal shared sun gear to which the planetary gear trains are connected has no fixed connection to one of the cylindrical body segments and is freely turnable.

9. A folder device as defined in claim 1, and further comprising external drive means for adjusting the planetary gear trains relative to one another.

* * * * *